US005440827A

United States Patent [19]

Klebahn et al.

[11] Patent Number: 5,440,827

[45] Date of Patent: Aug. 15, 1995

[54] REAR CLEAT FOR A SNOWSHOE

[75] Inventors: Perry A. Klebahn; James D. Klingbeil, both of San Francisco, Calif.

[73] Assignee: Atlas Snowshoe, Inc., San Francisco, Calif.

[21] Appl. No.: 91,973

[22] Filed: Jul. 15, 1993

Related U.S. Application Data

[63] Continuation of Ser. No. 748,425, Aug. 22, 1991, Pat. No. 5,253,437.

[51] Int. Cl.[6] ..... A63C 13/00; A43B 5/04

[52] U.S. Cl. ..... 36/122; 36/125

[58] Field of Search ..... 36/122, 124, 61, 62, 36/64, 65, 66, 67 R, 67 B, 59 R, 134, 126

[56] References Cited

U.S. PATENT DOCUMENTS

| | | | |
|---|---|---|---|
| 37,558 | 1/1863 | Field | 36/62 |
| 754,577 | 3/1904 | Laub | 36/62 |
| 988,527 | 4/1911 | Wiseman | 36/59 R |
| 996,610 | 5/1911 | Smith . | |
| 1,045,565 | 11/1912 | Kirton et al. | 36/65 |
| 1,200,658 | 10/1916 | Senf | 36/61 |
| 1,230,118 | 6/1917 | Clifford | 36/66 |
| 1,570,791 | 1/1926 | Solarz . | |
| 1,728,783 | 9/1929 | Chase | 36/62 |
| 2,499,516 | 3/1950 | Marceau . | |
| 2,579,143 | 12/1951 | Fisher | 36/62 |
| 2,920,403 | 1/1960 | L'Etoile | 36/61 |
| 3,670,513 | 9/1973 | Corneliusen . | |
| 4,005,533 | 2/1977 | Anderson et al. | 36/62 |
| 4,286,396 | 9/1981 | Deacon . | |
| 4,720,928 | 1/1988 | Faber . | |
| 4,745,692 | 5/1988 | Liao . | |
| 4,910,883 | 3/1990 | Zock, Jr. | 36/62 |
| 5,253,437 | 10/1993 | Klebahn et al. | 36/122 |

OTHER PUBLICATIONS

Brochure—Injun Summer "Snowshoes and Bindings", 2 pages.

Brochure—Sherpa, Inc. "How to Select the Sherpa Snowshoe and the Sherpa Binding that best suits your needs", 1 page.

Brochure—Tubbs, "Opening New Frontiers", 3 pages.

Brochure—Polar Equipment, "the shape of the future", 4 pages.

Brochure—Redfeather, "Snowshoes-Accessories". The Redfeather Story, folded brochure.

*Primary Examiner*—Steven N. Meyers

*Attorney, Agent, or Firm*—Thomas M. Freiburger

[57] ABSTRACT

An improved snowshoe includes a frame at least partially covered by a membrane, a front claw, and biased mounting means for pivotally attaching the front claw to the frame at an offset relative to a neutral frame plane. The biased mounting permits the user's foot to pivot the front claw downward increasing friction with the underlying terrain, but also urges the snowshoe to pivot toward an angle restoring the offset when the snowshoe is lifted. This results in the back of the snowshoe being urged downward, minimizing snow throwing by the snowshoe back, without producing dragging. At the same time, the front of the snowshoe is urged upward, tending not to trip the user. The biased mounting means preferably includes at least one resilient strap attached to the frame and, at the strap center, to the front claw. The preferred embodiment includes a rear cleat mounted to the upper membrane surface, and including at least one wall projecting downward through the membrane. This rear cleat minimizes snowshoe skating and allows the snowshoe to be used confidently downhill. Alternatively, a rear cleat may be mounted to the back and/or sides of the snowshoe frame. Further, a rear cleat according to the present invention may be retrofitted to an existing snowshoe to minimize rear sway and allow confident downhill use. Alternatively, a rear cleat according to the present invention may be retrofitted to the user's boot.

7 Claims, 4 Drawing Sheets

REAR CLEAT FOR A SNOWSHOE

This is a continuation, of application Ser. No. 07/748,425, filed Aug. 22, 1991 now U.S. Pat. No. 5,253,437.

FIELD OF THE INVENTION

This invention relates to winter outdoor gear, and more particularly to snowshoes.

BACKGROUND OF THE INVENTION

Snowshoes have long been used for walking on snow or ice covered terrain. A conventional snowshoe has a frame covered by a membrane, a front claw on the bottom front of the membrane, and straps to attach the snowshoe to a user's foot. The front claw is usually pivotally attached to the frame, beneath the ball of the user's foot. The user's weight at the ball of the foot causes the front claw to dig into the underlying terrain, providing friction that enables forward motion.

When used on level or uphill terrain, the snowshoe allows the user to walk about on snow or ice. Although the back of the snowshoe tends to drag along and skate or slide, the front claw permits forward motion because the user's center of gravity remains in a stable position.

It is known in the art to provide a flap-like cleat on the bottom of a snowshoe to improve its hill climbing ability. The cleat front hinges to the snowshoe, and the cleat "closes" against the snowshoe when pressed against the snow or ice. When the snowshoe is lifted, a spring urges the back of the cleat away from the snowshoe, into an "open" position preventing the snowshoe from sliding backward, thus promoting uphill use. However snow and ice debris can accumulate within the cleat, hampering snowshoe performance by preventing the cleat from fully closing.

Although suitable for level and uphill terrain use, conventional snowshoes do not perform well downhill because the rear of the snowshoe tends to skate or slide on the terrain surface. This skating prevents the user from maintaining a stable body position over the snowshoe. Commonly the user's weight is too far forward, causing the front claw to act as a fulcrum point about which the user pivots forward, usually just before falling to the ground. On the other hand, if the user's weight is shifted rearward, the snowshoe skating usually results in a backward fall backward because a stable body position cannot readily be maintained.

Conventional snowshoes suffer from other deficiencies as well. Often the front claw accumulates snow and ice, diminishing the claw's ability to bite into the terrain and to create friction. In some designs, the snowshoe is allowed to pivot freely on the front claw mounting axis, with the result that the rear of the snowshoe drags with each step. This dragging retards rapid user movement, such as running. Other designs minimize the rear dragging by mounting the front claw so as to urge the snowshoe to return to a horizontal disposition with each step, a configuration that promotes running. But as it is lifted from the terrain with each step, the snowshoe pivots downward about the front claw's mounting axis as the snowshoe tries to return to a generally horizontal disposition. As a result, the snowshoe front pivots downward and tends to accumulate snow and trip the user, while the snowshoe rear pivots upward and throws any snow thereon forward, usually striking the user's legs.

Because of the above limitations, conventional snowshoe travel tends to be slow, and considerable practice is required before any proficiency is attained. Although snowshoe travel could provide meaningful exercise, the inability to run, and to travel downhill confidently limits recreational snowshoe use.

In conclusion, there is a need for a mechanism to minimize skating at the back of a snowshoe, and to permit a snowshoe to be used on downhill terrain. Such a mechanism should not add appreciable weight or cost to a snowshoe, and preferably could be retrofitted. Also needed is a mechanism to minimize snow accumulation at the front claw of a snowshoe. Finally, there is a need for a mechanism that minimizes snow tossing without dragging the snowshoe rear, and that lifts the snowshoe front over obstacles so as not to trip the user. A snowshoe equipped with these mechanisms would permit running and other beneficial snowshoe exercise, even by a novice. The present invention meets these needs.

SUMMARY OF THE INVENTION

The present invention is a snowshoe that includes a frame that is at least partially covered by a membrane, and a front claw that is biasedly mounted to the frame at an offset. This biased mounting urges the snowshoe rear to pivot down and away from the user's foot, thereby minimizing snow throwing by the back of the snowshoe, without producing dragging. Further, because the front of the snowshoe is simultaneously urged upward toward the user, there is little tendency for the snowshoe front to collect snow and trip the user. This pivot action is especially beneficial when the snowshoe is used in soft snow, because it enables a user to step out of a deep hole without tripping. This front claw offset bias mounting is in contrast to the prior art, wherein biasing is either absent or restores a horizontal snowshoe disposition without offset.

The front claw is preferably mounted to the frame with at least one resilient strap, with the front claw walls projecting downward, below the plane of the frame. So mounted, the front claw tends not to accumulate snow between the front claw walls for several reasons. First, use of the snowshoe creates vibrations that are transmitted via the mounting straps to the snow facing surface of the front claw where they tend to shake loose any snow accumulating within the front claw. Second, the mounting strap material preferably is a poor thermal conductor relative to the front claw. As a result, the mounting-strap covered surface of the front claw is relatively "warm" and tends to retard snow from freezing to the front claw. Preferably a piece of freeze-resistant membrane material covers the mounting-straps on the undersurface of the front claw, to further minimize debris accumulation.

The present invention also provides a rear cleat that minimizes skating and sliding at the rear of the snowshoe, and improves friction when going downhill. The rear cleat preferably includes a debris facing surface to which at least one projecting wall is attached. Preferably the rear cleat includes first and second projecting walls that converge rearward without meeting, and are inclined relative to the debris facing surface. Because they preferably do not meet, the projecting walls leave an open area at the rear so as not to trap snow within the cleat.

A rear cleat according to the present invention may be mounted at a rear portion of the membrane, with the projecting walls penetrating downward through the membrane. So mounted, the rear cleat tends not to accumulate snow for the same reasons that the front claw tends not to accumulate snow. Alternatively, a rear cleat according to the present invention may be attached to the snowshoe frame.

Further, a rear cleat according to the present invention may be provided as a retrofit accessory for an existing snowshoe. In one embodiment, a rear cleat may be provided as a retrofit accessory for the user's boot. In this embodiment, the cleat attaches to the boot heel and the cleat wall projects downward through an opening made in the membrane on an existing snowshoe.

A snowshoe provided with a rear cleat according to the present invention may be used confidently on downhill terrain. Further, because the rear cleat minimizes rear skating or sliding, relatively little practice will be required before attaining proficiency on the snowshoe.

Finally, the present invention includes straps that preferably have a hook and loop fastening material (e.g., Velcro TM brand material) for attaching the snowshoe to a user's foot. Such straps allow the user to attach or adjust the snowshoe in freezing weather, even while wearing bulky mittens.

It is an objective of the present invention to provide a snowshoe that minimizes rear sliding or skating, and that may be used by a novice without substantial practice over all types of terrain, including downhill. This objective is met by providing a snowshoe with a rear cleat as described, or by providing a user's boot with a cleat as herein described.

It is a further objective of the present invention to provide a snowshoe that urges the front of the snowshoe upward and the back of the snowshoe downward when the snowshoe is lifted from the ground, without allowing the snowshoe rear to drag. This objective is met by pivotally mounting the front claw to the snowshoe frame to biasedly retain an offset between the front claw and the snowshoe plane.

It is a still further objective of the present invention to provide a snowshoe that minimizes snow accumulation within the front cleat and (if present) rear cleat. This objective is met by mounting the cleat on top of the snowshoe membrane, with the cleat walls projecting downwardly, beneath the level of the snowshoe plane. This objective is further met by providing a membrane that is a relatively poor thermal conductor compared to the cleat, and that tends to resist freezing.

It is a final objective of the present invention to provide a snowshoe that can be used for running and exercising, over varying terrain. This objective is met by providing a snowshoe with an offset biased front claw mounting, and a rear cleat.

Other features and advantages of the invention will appear from the following description in which the preferred embodiments have been set forth in detail in conjunction with the accompanying drawings.

DETAILED DESCRIPTION OF THE PREFERRED EMBODIMENTS

Figure 1:
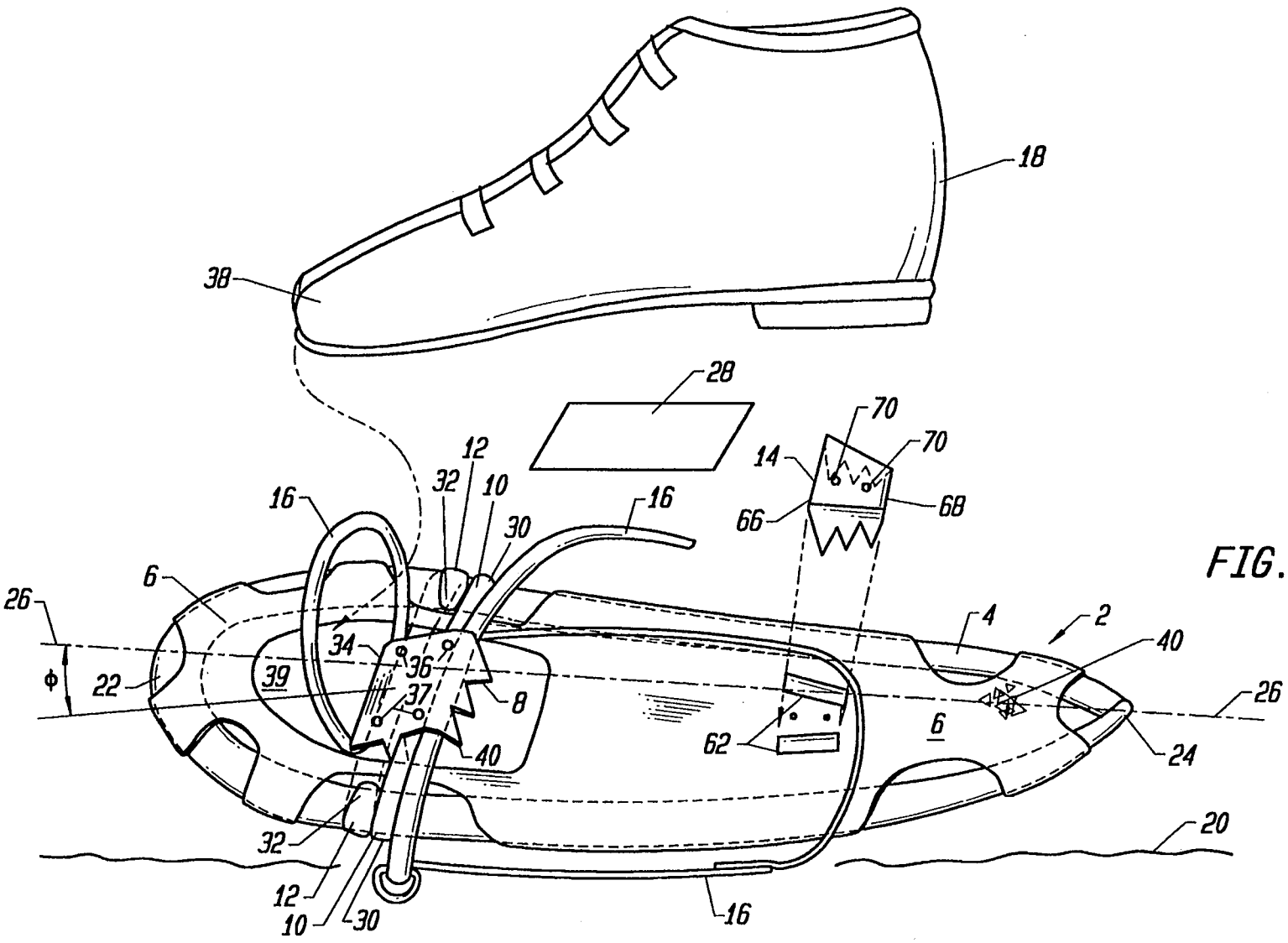
FIG. 1 is a breakaway, perspective view of a snowshoe, according to a first embodiment of the present invention.

FIG. 1 depicts a snowshoe 2 according to a first embodiment of the present invention as including a frame 4, a membrane 6 at least partially covering the frame, a front claw 8, first and second straps 10, 12 that biasedly mount the front claw to the frame, a rear claw 14 and straps 16 for attaching the snowshoe to a user's boot 18. The underlying snow or ice terrain upon which the snowshoe 2 is used is shown generally as 20. The frame 4 has a front end 22, a back end 24, and a lateral axis 26 extending between the two ends. Frame 4 also defines a neutral plane 28, essentially parallel to the upper surface of the membrane 6 over the center region of the frame 4.

Figure 2:
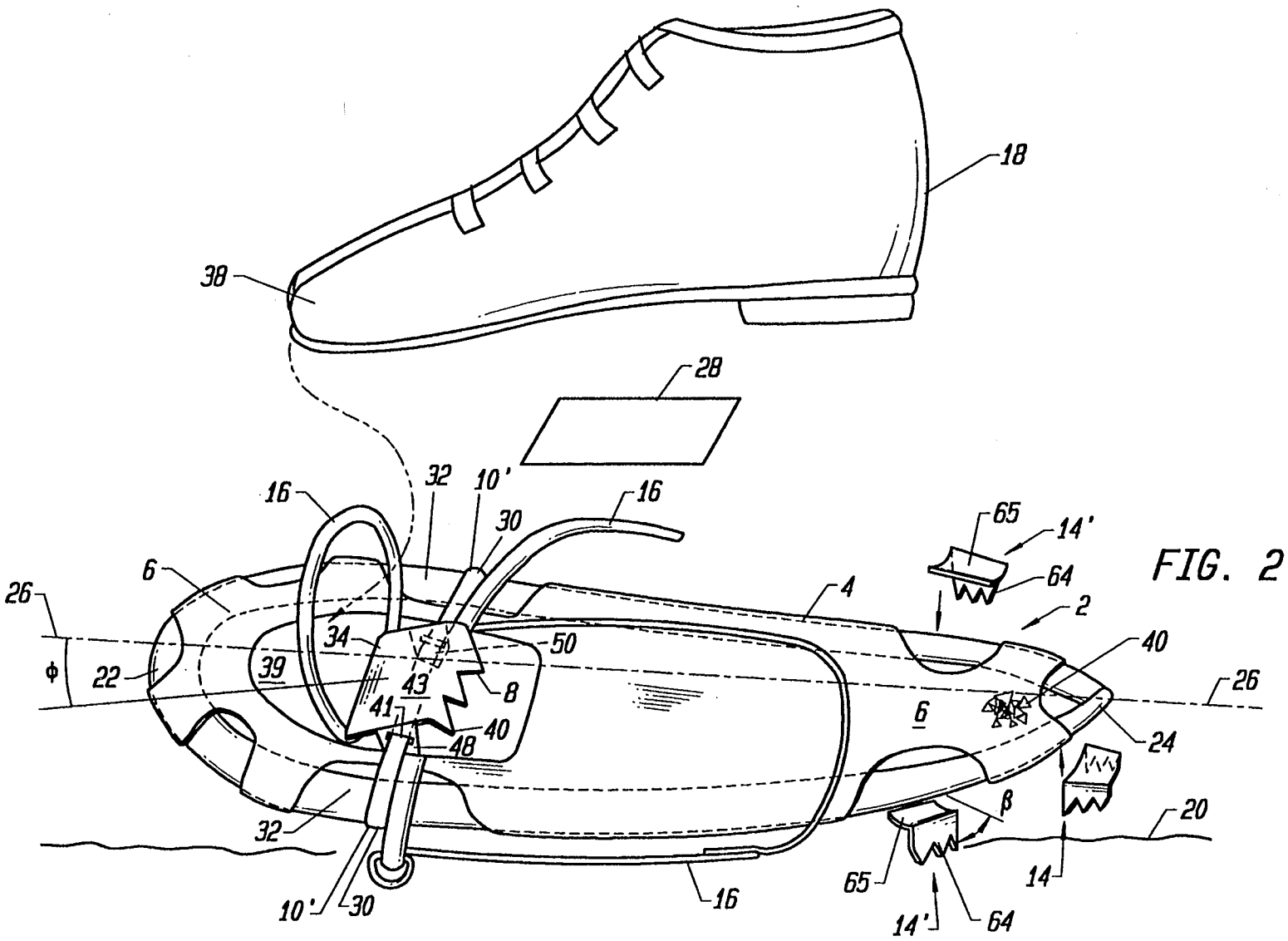
FIG. 2 is a breakaway, perspective view of a snowshoe, according to a second embodiment of the present invention.
Figure 3:
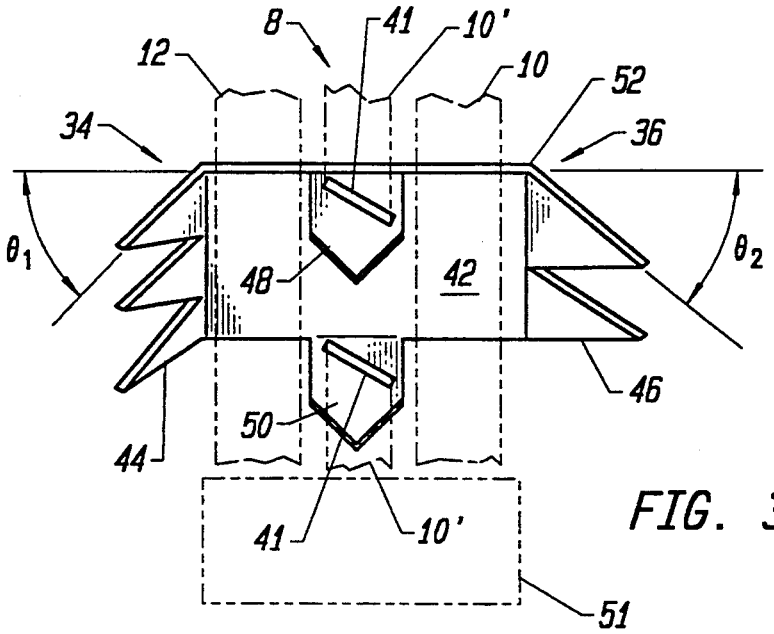
FIG. 3 is a perspective view of one embodiment of a front claw, according to the present invention.

First strap 10 preferably passes over frame 4, and is attached at each strap end 30 to the frame. Second strap 12 preferably passes beneath frame 4 and is attached at each strap end 32 to the frame. The center portions of each strap 10, 12 preferably attach to the underside of the front claw 8, using screws or rivets 36, although other attachment means could be used as well. Alternatively, the strap ends 30, 32 may be joined such that straps 10, 12 form a single, continuous strap that is connected to the frame, for example at location 10 or 12 in FIG. 1. In lieu of two straps 10, 12, or a single strap wound around the frame 4 as shown in FIG. 1, a desired biased, pivotal mounting of the front claw 8 may be provided with a single strap 10' as shown in Figure 2 and FIG. 3. The single strap 10' is attached to the frame 4 at the strap ends and attached to the underside of the front claw 8 at the strap center. It is understood that screws, rivets, or the like may be used to attach the front claw 8 to the strap 10', or to straps 10, 12.

As shown in FIG. 1, the frontmost portion 34 of the front claw 8 is biased by the straps 10, 12 generally downward, toward the underlying terrain 20. The plane of the front claw upper surface 37 forms an angle $\phi$ relative to the neutral snowshoe plane 28 of about 35°, although an angle $\phi$ from about 10° to about 45° could also be used.

When the snowshoe 2 is attached to the user's boot 18 by means of straps 16, the frontmost portion 34 of claw 8 pivots downward as the user pushes the front 38 of boot 18 downward. An opening 39 is provided in the front region of the membrane 6, permitting the front claw 8 (and the front of the user's boot 18) to pivot as described. The pivot action permits the projecting walls 40 on the front claw 8 to bite into the underlying terrain 20, increasing friction between the terrain 20 and the snowshoe 2. However when the snowshoe 2 is lifted from the terrain 20, the resiliency of the straps 10, 12 urges restoration of the offset originally imparted to the front claw 8. As will be described more fully with regard to FIGS. 4A and 4B, the snowshoe back end 24 is urged generally away from the user, while the front end 22 is simultaneously urged away from the terrain 20. FIG. 2 depicts a second preferred embodiment wherein a single strap 10' passes through an inclined slot 41 in the sidewalls 48, 50 of the front claw 8. The slot 41 is preferably inclined relative to the plane of the upper surface 43 of the front claw to produce the desired bias angle $\phi$ (e.g., about 10° to about 45°). According to FIG. 2, the rear cleat 14 may be attached to the frame 4, preferably at the back end 24. Alternatively or in addition, separate rear cleats 14' may be attached elsewhere to the frame 4. In FIG. 2, the rear cleats 14' include a preferably serrated sidewall 64 that projects downward from a frame facing surface 65. The sidewall 65 preferable is inclined an angle $\beta$ relative to surface 65, where $\beta$ is about 35° to about 90°. Alternatively, cleats 14' could be formed without surface 65, in which case sidewall 65 would itself be attached to the frame 4. It is understood that the rear cleat 14, or rear cleats 14' may be attached to the frame using screws, rivets, or the like.

In the preferred embodiment, the frame 4 is a single piece of 0.75" O.D. (19 mm), 0.035" (0.9 mm) wall, 6061 T6 aluminum tubing joined together at the back end 24 by a T.I.G. weld. Screws, rivets, swaging or the like could be used instead of welding, and the frame 4 could of course be made from other materials, a single piece of cast plastic, for example. The membrane 6 is preferably somewhat resilient and provides a shock-absorbing function for the snowshoe 2. In the preferred embodiment, the membrane 6 is a 40 oz. (1.1 Kg) Hypalon TM brand coated material manufactured by Dupont. Applicants have found this to be an excellent material choice because it is does not readily allow other materials to freeze to it, and it is also a poor thermal conductor. Of course other materials could be used, such as canvas, rubber, plastic, sheet metal, and the membrane 6 could be a mesh, such as on a tennis racket.

The front claw 8, and the rear claws 14, 14' are each preferably constructed from a single piece 0.100" (b 2.5 mm) 6061 T6 aluminum sheet, although other metals or materials might also be used. The straps 10, 12, 10' are preferably strong and slightly resilient material, such as a double insert neoprene. The mounting straps 16 are preferably nylon and have mating surfaces of hook and loop type fastening material, such as Velcro TM brand material. This allows the snowshoe 2 to be attached to a user's boot 18, or to be readjusted, even in freezing weather while mittens are worn.

FIG. 3 is a detailed perspective view (from below) of a preferred embodiment of the front claw 8. The front claw 8 includes a terrain facing surface 42 to which spaced apart first and second projecting walls 44, 46 are attached, and optionally spaced apart third and fourth projecting walls 48, 50, as well. The first and second walls 44, 46 are respectively attached to the frontmost end 34 and rearmost end 52 of the front claw 8, preferably at angles $\theta_1$, $\theta_2$ with respect to the plane of the terrain facing surface 42. In the preferred embodiment $\theta_1=\theta_2\approx 40°$, although it is not necessary that each angle be the same, and any angle between about 30° and 90° may be used. Preferably the first and second walls 44, 46 have serrated edges, although (as shown) the number and shape of the serrations need not be identical for each wall.

The third and fourth walls 48, 50 are preferably offset at about 90° relative to the plane of surface 42, although other offsets could be used. FIG. 3 shows (in phantom) straps 10, 12 which, in the first preferred embodiment, are mounted to the surface 42 on either side of the walls 48, 50. FIG. 3 further shows the offset slots 41 in the walls 48, 50 that are provided if a single mounting strap 10' (shown in phantom) is employed, according to the second preferred embodiment. Also shown in phantom in FIG. 3 is a piece of membrane material 51 that optionally is provided to cover straps 10, 12 to improve the debris rejecting ability of the front claw 8.

Figure 4A:
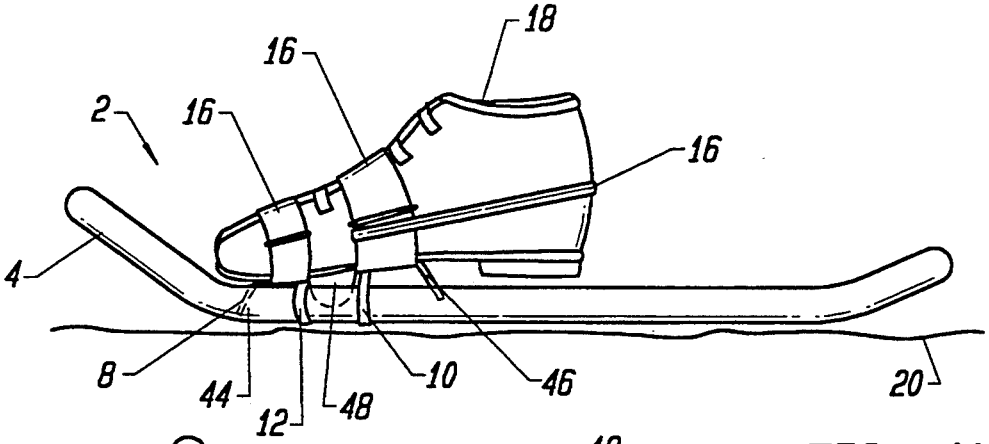
FIGS. 4A and 4B are schematic sideviews showing the pivotal response of the front claw to displacing bias, according to the present invention.
Figure 4B:
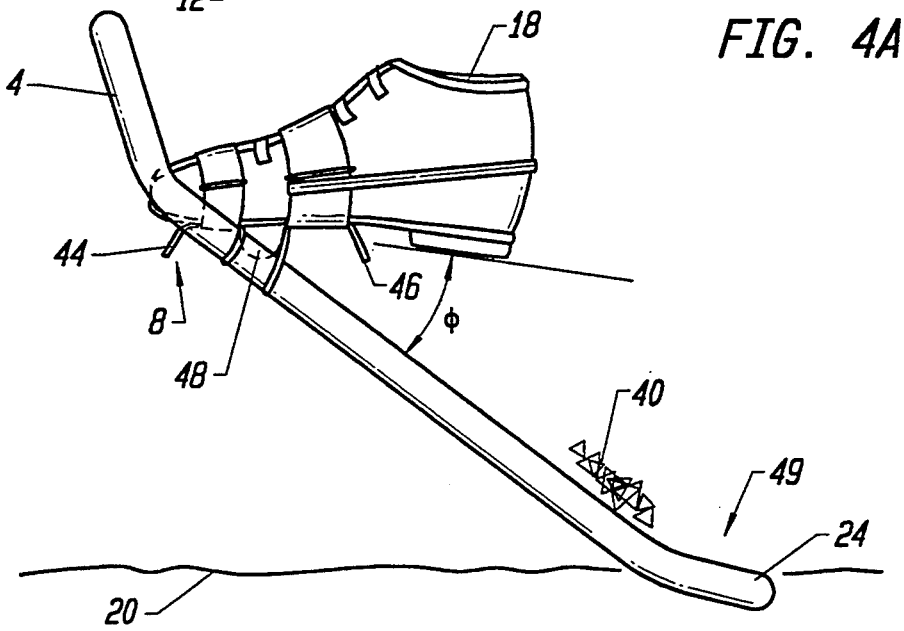

FIGS. 4A and 4B show the biasing action produced in the front claw 8 by straps 10, 12 (or by a single strap 10' passing through an inclined slot 41, according to the second preferred embodiment). In FIG. 4A, the user's boot 18 has pressed the snowshoe 2 downward, into the terrain 20. As a result, the front claw 8 is urged pivotally away from the "no-load" disposition shown in FIG. 1 where, absent force from above, the front region 34 of the claw 8 was biased downward, with $\phi\approx=35°$. The angle $\phi$ is essentially reduced to about 0° in FIG. 4A, and the projecting walls 44, 46, 48 may be firmly pressed into the terrain 20, maximizing friction between the terrain and the snowshoe 2. As the claw 8 is urged into a generally horizontal disposition (relative to the frame plane 28), the straps 10, 12 are rotated or twisted somewhat. Because straps 10, 12 are preferably resilient, they constantly urge the front claw 8 to return toward the "no-load" disposition of FIG. 1 (a condition that minimizes the rotation or twisting of the straps 10, 12).

FIG. 4B shows the condition occurring when the user lifts snowshoe 2 away from the terrain 20, a condition occurring with each snowshoe step. As the snowshoe 2 is lifted away from the terrain 20, the straps 10, 12 tend to untwist (as would a single strap 10' in the second preferred embodiment), causing the angle $\phi$ to increase from about 0° to the original offset (e.g., about 35° in the preferred embodiment). In the process, the snowshoe front end 22 is urged upward, and the rear end 24 is urged downward, as indicated by the arrows 49. Because the front end 22 is urged upward, it tends not to trip the user. By the same token, because it is urged downward, the rear end 24 tends to dislodge any debris 40 (e.g., snow, ice) thereon away from the user rather than toward the user's leg.

Figure 5A:
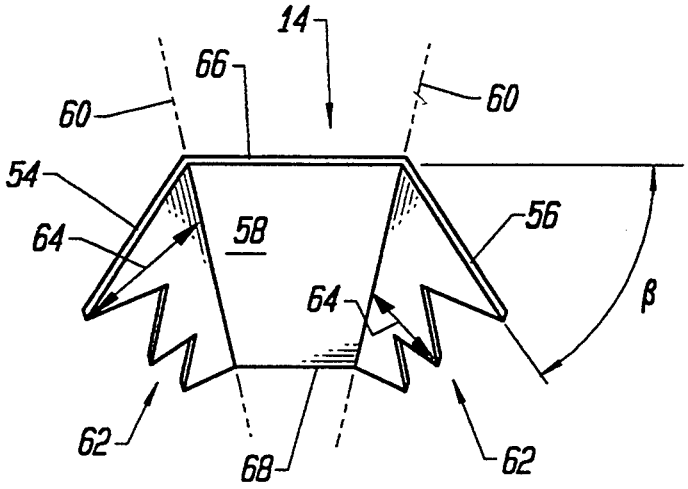
FIGS. 5A and 5B are perspective views of various rear cleat embodiments, according to the present invention.

FIG. 5A is a perspective view (from below) of a preferred embodiment of the rear cleat 14, according to the present invention. The rear cleat 14 preferably includes spaced apart first and second projecting walls 54, 56 joined to a terrain facing surface 58. Preferably the walls 54, 56 are displaced an angle $\beta$ relative to the surface 58, where $\beta$ is about 35° to about 90°. In FIG. 5A, the junctions 60 formed by the interfaces between the walls 54, 56 and the surface 58 are shown as converging, e.g., non-parallel. The junctions 60 could, however, be parallel, as is the case in the front cleat 8 shown in FIG. 3. While FIG. 5A shows a rear cleat 14 with two projecting walls 54, 56, the rear cleat could have fewer or more projecting walls, and could, for example, resemble the front claw 8.

Preferably the edges 62 of the walls 54, 56 are serrated, the better to grip the underlying terrain 20. In FIG. 5A, the height 64 of the walls 54, 56 is shown as varying. The height 64 could of course be constant, as was the case with the sidewalls shown in FIG. 3 for the front claw 8. Preferably the front facing portion 66 of the rear cleat 14 is wider than the rear facing portion 68. (When viewed from above the snowshoe 2, the front portion 66 is about 3" (75 mm) across, and the rear facing portion 68 is about 1" (25 mm) across, although other dimensions could be used as well.) This configuration seems to improve the friction generating ability of the rear cleat 14. However it is preferred that there be an open area adjacent portion 68 (as is the case in FIG. 5A) that prevents debris from accumulating within the rear cleat, and not being allowed to escape. (For example, if projecting walls 54, 56 converged adjacent portion 68, debris caught within the rear claw 14 would be trapped therein.)

As shown in FIG. 1, preferably the rear cleat 14 mounts to the membrane 6 from above, such that the terrain facing surface 58 contacts the membrane 6, rather than the terrain 20 directly. This method of mounting is preferred because vibrations in the snowshoe 2 are better transmitted to the heel claw 14 and tend to dislodge any debris otherwise tempted to remain in claw 14. Also, snow and ice are less likely to adhere to the membrane 6 than to the surface 58. As noted, membrane 6 is a poor thermal conductor (as contrasted with heel claw 14) and in the preferred embodiment is a material that almost prohibits other materials from freezing to the membrane. The rear cleat 14 is attached to the membrane 6 using rivets or screws 70.

FIGS. 1 and 2 depict a rear cleat 14 and/or 14' used in conjunction with an improved snowshoe according to the present invention. However a rear cleat 14 and/or 14' according to the present invention may be retrofitted to a conventional snowshoe. FIGS. 1 and 2 illustrate that a rear cleat 14 may be retrofitted by attachment through the membrane 6, or by attachment to the rear or sides of the frame 4 (or by retrofitting a combination of such rear cleats). Such attachment may be made with screws, rivets or the like. An existing snowshoe retrofitted with a rear cleat 14 or 14' will exhibit decreased rear skating, and improved downhill capability.

Figure 5B:
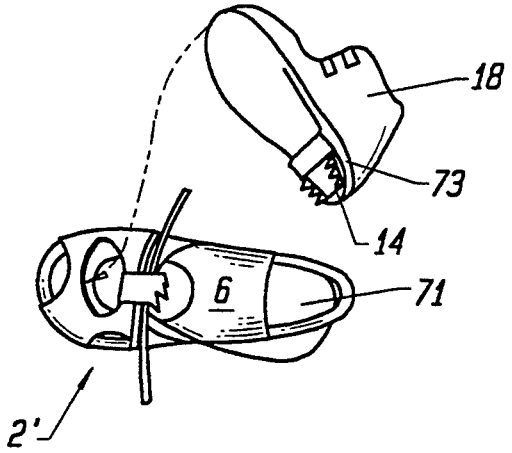

Alternatively, a rear cleat 14 may be retrofitted to the heel of a user's boot to minimize rear skating and enhance downhill capability of a snowshoe. FIG. 5B shows such an embodiment wherein a snowshoe 2' includes a heel sized opening 71 in the membrane 6. In this embodiment, a rear cleat 14 according to the present invention is affixed to the underside of the heel 73 of the user's boot, using screws, nails, a strap, or the like. In use, the rear cleat 14 projects downward through the opening 71.

Figure 6A:
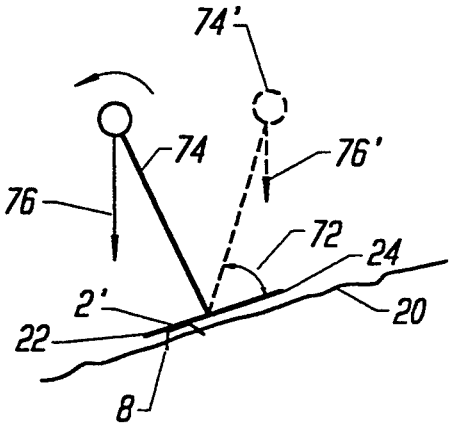
FIGS. 6A and 6B are schematic representations demonstrating the stability afforded a snowshoe equipped with a rear cleat, according to the present invention.
Figure 6B:
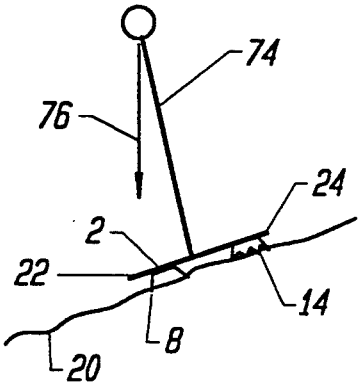

FIGS. 6A and 6B illustrate the advantages resulting from a rear cleat 14 according to the present invention. FIG. 6A shows a snowshoe 2' having no rear cleat. Because there is not a great deal of friction between the frame end 24 and the generally downhill terrain 20, the rear of the snowshoe 2' tends to skate with each step, as shown by the arrow 72. This skating action makes it difficult for the user (shown schematically as 74) to maintain a stable position. To try to minimize the skating, the user often leans too far forward, causing the user's center of gravity 76 to project downward too far in front of the front claw 8. The claw 8 acts as a fulcrum point (by virtue of its friction with the terrain 20), and all too often the user 74 will tumble forward when attempting to snowshoe downhill. Alternatively, if the user leans too far backward (shown in phantom in FIG. 6A), the user's center of gravity (shown in phantom as 76') projects downward too far rearward. The result in this case is that the snowshoe 2' tends to skate forward, causing the user 74' to fall backward.

By contrast, snowshoe 2 in FIG. 6B includes a rear cleat 14 (and/or 14') that provides positive friction at the rear of the snowshoe 2', minimizing the skating action shown in FIG. 6A. The user 74 can now confidently establish and maintain a stable position, enabling the center of gravity 76 to project downward to a region between the front claw 8 and the rear claw 14, 14'. As a result, the user remains upright rather than falling forward or backward, and snowshoe 2 may be used with confidence in downhill travel (in addition, of course, to travel on level or uphill terrain).

In summary, a snowshoe 2, or a conventional snowshoe 2', equipped with a rear cleat 14 and/or 14' according to the present invention allows even a novice user to travel comfortably without a great deal of practice, even over downhill terrain. In addition, such a snowshoe 2 may be used for running or other beneficial snowshoe exercise. While FIGS. 1 and 2 depict a snowshoe 2 equipped with all of the improvements described herein, a snowshoe may of course be improved by adopting less than all of the disclosed improvements.

Modifications and variations may be made to the disclosed embodiments without departing from the subject and spirit of the invention as defined by the following claims

What is claimed is:

1. A rear cleated snowshoe, comprising:

a snowshoe frame;

a membrane covering at least part of said frame; and a rear cleat including a member having a terrain-facing surface and fixedly attached thereto downwardly projecting spaced-apart first and second sidewalls;

wherein said rear cleat is attached to a rear portion of said snowshoe such that said terrain-facing surface of said member is attached adjacent an upper surface of said membrane, and wherein said membrane defines spaced-apart sidewall-sized openings through which said openings said sidewalls project, said sidewalls extending downward lower than said membrane.

2. The rear cleated snowshoe of claim 1, wherein said sidewalls of said rear cleat are parallel to one another.

3. The rear cleated snowshoe of claim 1, wherein said sidewalls of said rear cleat are spaced-apart from each other a greater distance adjacent a forward-facing portion of said cleat than adjacent a rearward-facing portion of said cleat.

4. The rear cleated snowshoe of claim 1, wherein said member and said sidewalls of said rear cleat are a single piece of metal.

5. The rear cleated snowshoe of claim 1, wherein at least one of said sidewalls of said rear cleat is inclined about 35° to about 90° relative to said snowshoe plane.

6. The rear cleated snowshoe of claim 1, wherein at least one of said sidewalls of said rear cleat includes a serrated terrain-facing edge.

7. The rear cleated snowshoe of claim 1, wherein at least one of said sidewalls of said rear cleat projects a varying distance from said plane.

* * * * *